US005239940A

United States Patent [19]

Griffin

[11] Patent Number: 5,239,940

[45] Date of Patent: Aug. 31, 1993

[54] TRANSPORTABLE RAFT ASSEMBLY

[76] Inventor: Vernon G. Griffin, 27421 Clarksburg Rd., Damascus, Md. 20872

[21] Appl. No.: 876,446

[22] Filed: Apr. 30, 1992

[51] Int. Cl.[5] ..... B63B 35/00

[52] U.S. Cl. ..... 114/353; 441/129; 114/357

[58] Field of Search ..... 114/352, 353, 357, 140; 441/35, 129, 130

[56] References Cited

U.S. PATENT DOCUMENTS 4,443,204 4/1984 Perrin ..... 441/129
4,662,851 5/1987 Foster ..... 441/129
4,825,799 5/1989 Bergeron et al. ..... 114/353

*Primary Examiner*—Edwin L. Swinehart
*Attorney, Agent, or Firm*—Richard C. Litman

[57] ABSTRACT

An easy to carry raft of two sections that is folded along a longitudinal, vertical center plane for transporting and storage. A keel is made of either a length of flat, flexible plastic, an elongate, flexible nylon strap secured along the hull of the raft, or a length of PVC pipe with transversely extended pipe sections forming strengthening ribs. The strap acts as a hinge when the raft is folded. Cross pipes through the raft sections provide structural rigidity for the raft embodiments having a flexible keel. These cross pipes are removed when the raft is folded for transport and storage. Railings on the deck made of PVC pipe sections or bent aluminum tubing are common to all embodiments, and connect with the PVC pipe ribs in the embodiment having a PVC pipe keel. The raft may be made from a wide choice of foam materials, and in different colors. A solid raft embodiment is disclosed, including railings and cross pipes for further strength.

12 Claims, 5 Drawing Sheets

TRANSPORTABLE RAFT ASSEMBLY

BACKGROUND OF THE INVENTION

1. Field of the Invention

The present invention relates to the field of water transportation, and more specifically, to a new and improved small-sized, portable, solid or foldable, durable raft or boat that can be quickly and easily assembled for use and then simply folded when not in use, to facilitate carrying by hand. In the folded embodiment, a removable plastic rod with hinges forms the spine of a skeleton of recessed rods running longitudinally through the center of the raft to allow the raft to be folded in half. The plastic rod also functions as a handle grip for facilitating carrying of the raft over land. Once unfolded, the raft has multiple purposes such as for fishing but not limited to such.

2. Description of the Prior Art

Both solid and foldable fishing rafts or boats are known. However, such prior art rafts have many shortcomings. For example, many are so heavy as to preclude carrying by hand whether solid or foldable for storage or transport. Others cannot be folded or reduced in size for transportation by hand. Most are made of an undue number of separable components, making assembly and disassembly both complicated and time consuming. Furthermore, small parts of such rafts tend to be easily lost.

U.S. Pat. No. 4,730,573 issued Mar. 15, 1988 to Terry D. Koon discloses a collapsible, foldable boat of kayak configuration and made up of a multitude of flexibly connected, rigid, waterproof, structural plates.

U.S. Pat. No. 4,841,900 issued Jun. 27, 1989 to Jerzy Maselko discloses a foldable boat with halves dividing the boat transversely, and being hingedly connected together to form a cartop carrier. Removable stiffener rods are slid through guides on the floor of the two halves of the boat to hold the two halves in rigid assembly as a boat.

U.S. Pat. No. 4,919,632 issued Apr. 24, 1990 to Richard L. Smith, et al discloses a collapsible, one man pontoon fishing raft made of expanded polystyrene or styrofoam. A nylon storage bag is provided. PVC rods are inserted longitudinally through the pontoons for strength.

U.S. Pat. No. 5,052,324 issued Oct. 1, 1991 to Steve Lesly discloses a twin pontoon style, folding fishing boat. A folding structural plate joins the two pontoons together, the plate supporting a seat. Spaced cross rods maintain the pontoons in assembly and are removed so the pontoons may be folded together about a longitudinal axis defined centrally through the structural plate.

None of the above inventions and patents, taken either singly or in combination, is seen to described the instant invention as claimed.

SUMMARY OF THE INVENTION

An uncomplicated raft, foldable about a longitudinal centerline running from bow to stern, is provided by the instant invention. A center keel or spine made of flexible polyethylene, for example, or of a length of PVC or aluminum pipe sections, is provided, which imparts sufficient rigidity to the raft when unfolded for use, coupled with transverse ribs for maintaining the raft in assembly. In another embodiment, a solid yet equally lightweight raft includes a peripheral handle assembly and transverse stiffeners. This raft is easily transported by hand and requires no assembly at all for use and, of course, no disassembly for transport or storage.

Accordingly, it is a principal object of the invention to provide an improved, solid or foldable, portable raft for transporting a person, with sufficient room remaining on the raft for carrying fishing gear and other items.

It is another object of the invention to provide an inexpensive, solid or foldable raft that is made of foam plastic or the like, thereby making the raft lightweight, to facilitate carrying of the raft, even over rough terrain or through rather dense undergrowth.

It is a further object of the invention to provide a raft that is foldable in half and is easily assembled and disassembled.

It is still a further object of the invention to provide a compact, lightweight solid or folding raft made of foamed plastic material or the like, and being equipped with handles, for facilitating carrying of the raft.

Still another object is to provide a durable, solid or foldable, foamed synthetic material raft that floats in any configuration, thus making it very safe to use on confined bodies of water such as ponds and small lakes.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

With reference to the drawings, a first embodiment of the invention is disclosed in FIGS. 1-5, inclusive. A raft 10 includes two halves or sections 12, 14 of foam material construction. The foam material may be, for example, 220 polyethylene or similar foam material, or floatable material. Several ratings of foam material suggest themselves to those skilled in the art, in addition to 220 polyethylene. Furthermore, such materials may be selected from a wide variety of colors, again as is known to those skilled in the art. The point is that the invention provides an attractive, foldable raft constructed of very inexpensive materials.

Figure 1:
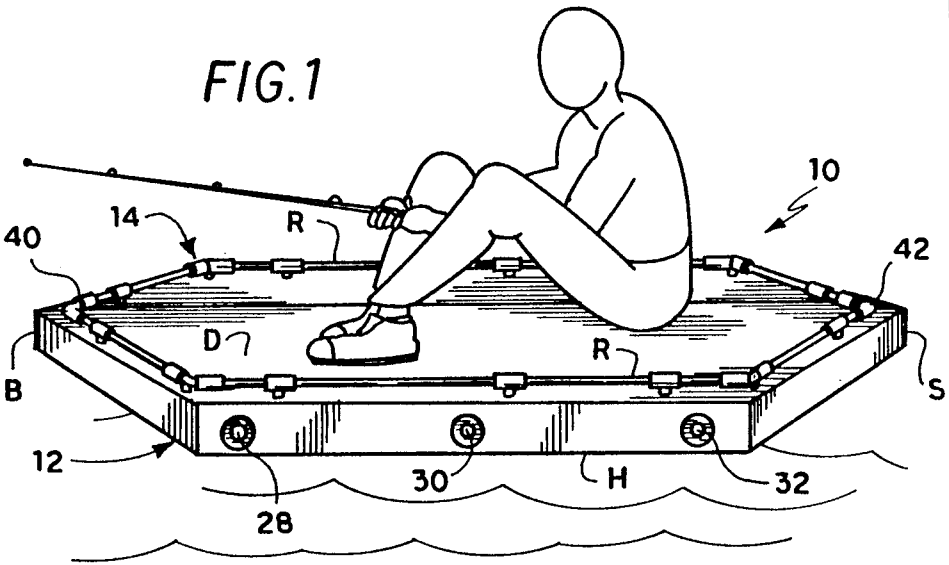
FIG. 1 is a perspective view of a raft constructed according to a first embodiment of the invention, illustrating its use carrying a person on a fishing excursion.

In assembly, and as shown in FIG. 1, raft 10 has a deck D, a hull H, a bow B and a stern S. The bow B and stern S are denominated arbitrarily, in this embodiment, as the raft 10 is symmetrical about both a longitudinal vertical center plane and a central transverse vertical plane. Other configurations, of course, readily suggest themselves. For example, stern S could be flat rather than pointed, or the raft could be oval or elliptically shaped, when viewed from above as in FIG. 4. In any event, in all but one of the embodiments, the two raft sections may be folded about a line lying in an imaginary, vertical center plane drawn longitudinally centrally through raft 10, and clearly defined by the abutting interior faces 16, 18 of the sections 12, 14, respectively.

Figure 2:
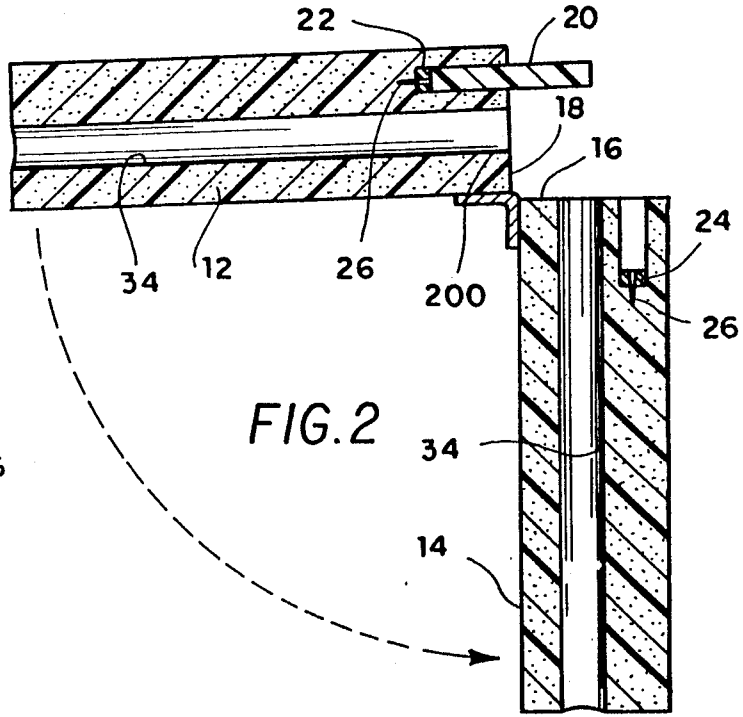
FIG. 2 is an enlarged scale, transverse sectional view of the raft shown in FIG. 1, illustrating folding of the two halves of the raft about a central, flexible keel.
Figure 3:
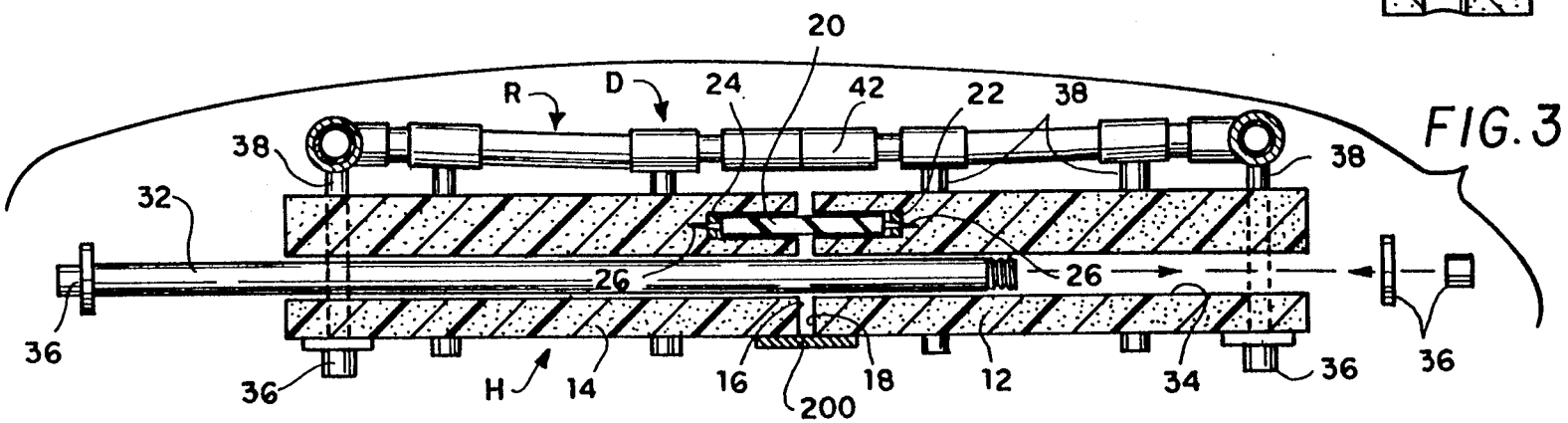
FIG. 3 is a transverse, sectional view similar to FIG. 2 but showing the raft in assembly, the view being drawn along lines 3—3 of FIG. 4.

In this first embodiment under discussion, an elongate, flexible nylon strap 200 is attached to the bottom of both sections 12 and 14 with suitable adhesives, acting as both a hinge and a keel. Additional support is provided by a spline 20, running the center length of raft 10, and affixed to one section 12, thereinto and through the face 16 by suitable fasteners, an adhesive, or simply friction. For additional strength, a pair of parallel rails 22, 24, also running the length of raft 10, may be mounted interiorly of each section 12, 14, respectively, by suitable fasteners such as nylon screws 26, as shown in FIGS. 2 and 3. This construction provides a raft with structural integrity in assembly, yet one in which the two halves 12, 14 may be folded together for transport and storage, as is indicated in FIG. 2.

Further structural integrity in assembly is provided by a plurality of transverse stiffeners in the form of lengths of commonly available, three quarter inch PVC or aluminum pipe sections 28, 30 and 32, received in bores formed entirely, laterally through raft 10, one of which is indicated at 34, in FIGS. 2 and 3.

Although three such transverse pipes 28, 30, 32 are shown, clearly more or fewer could be provided. These transverse pipes are inserted through the raft 10 and locked in place, by simple, PVC material cap and washer assemblies 36, the caps being threaded onto the outer ends of the pipes 28, 30 and 32. If desired, the cap and washer assembly on one end of each pipe 28, 30, 32 may be permanently affixed to reduce the chances of parts becoming lost. In any event, these pipes 28, 30 and 32 are assembled and disassembled as indicated in FIG. 3. After their removal from the bores, one of which is shown as 34, the raft sections may be folded together, as above, along the nylon strap 200 seen in FIGS. 2 and 3.

The raft 10 of this embodiment of the invention is completed by provision of a peripheral railing R formed of lengths of, for example, three quarter inch PVC piping or bent aluminum tubing which, in an oval embodiment of the raft, would be easier to manufacture and fit with a press: the rail lengths being connected together by PVC tees having depending vertical stanchions 38, extended entirely through raft 10 and secured therebeneath, to hull H by additional PVC cap and washer assemblies 36, threaded to the lower ends of stanchions 38. The bow B and stern S ends of railing R are completed by 90° PVC pipe elbows 40 and 42, respectively, which are simply friction fit onto railing R so they may be removed to allow the sections 12, 14 to be folded together along the nylon hinge 200 as illustrated in FIG. 2. With this simple provision of removable end elbows 40 and 42, the raft may be folded for transport and/or storage without need of removal of any of the pipe lengths and tees making up the railing R and stanchions 38.

Of course, the railing R provides not only a convenient handhold for the user of the raft, but also imparts further structural rigidity to the entire raft 10 in assembly.

Figure 6:
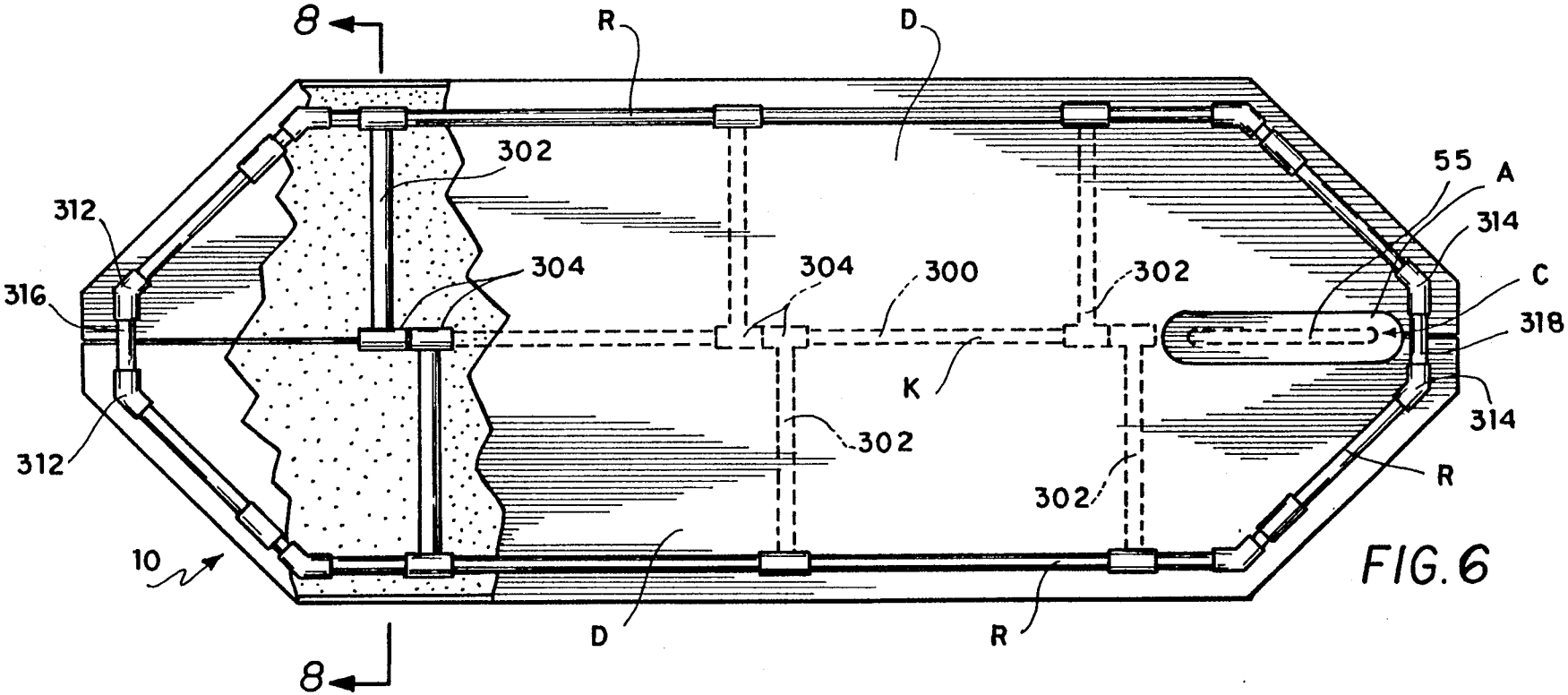
FIG. 6 is a top, plan view, similar to FIG. 4, but illustrating a second embodiment of the invention.
Figure 7:
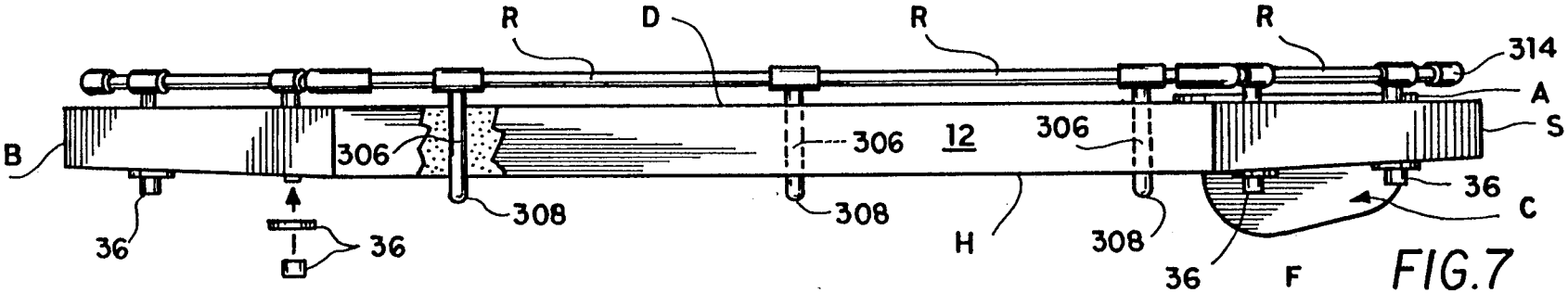
FIG. 7 is a side view of the invention as shown in FIG. 6.
Figure 10:
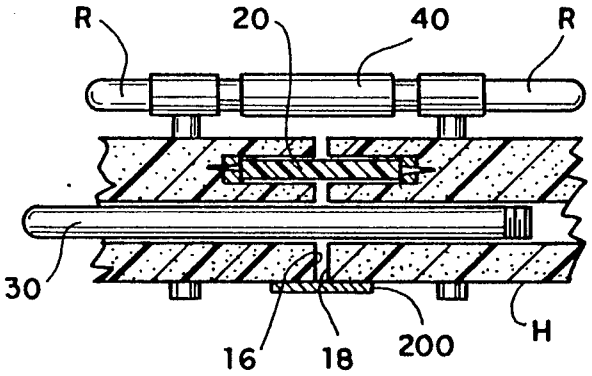
FIG. 10 is a partial, transverse sectional view similar to FIG. 3, but showing another embodiment of the invention.
Figure 9:
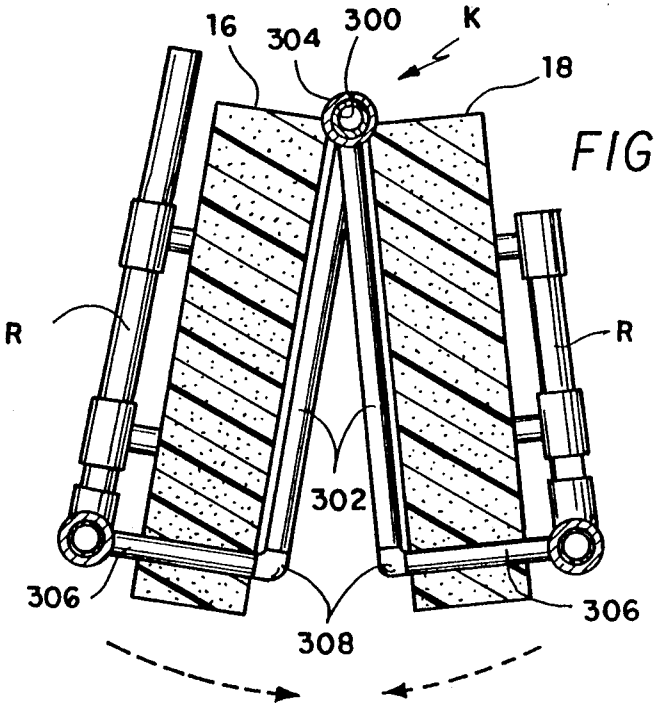
FIG. 9 is a transverse sectional view similar to FIG. 8 but showing folding of the two halves of the second embodiment of the invention about a longitudinal axis provided by a spine or keel made of sections of suitable PVC pipe.
Figure 8:
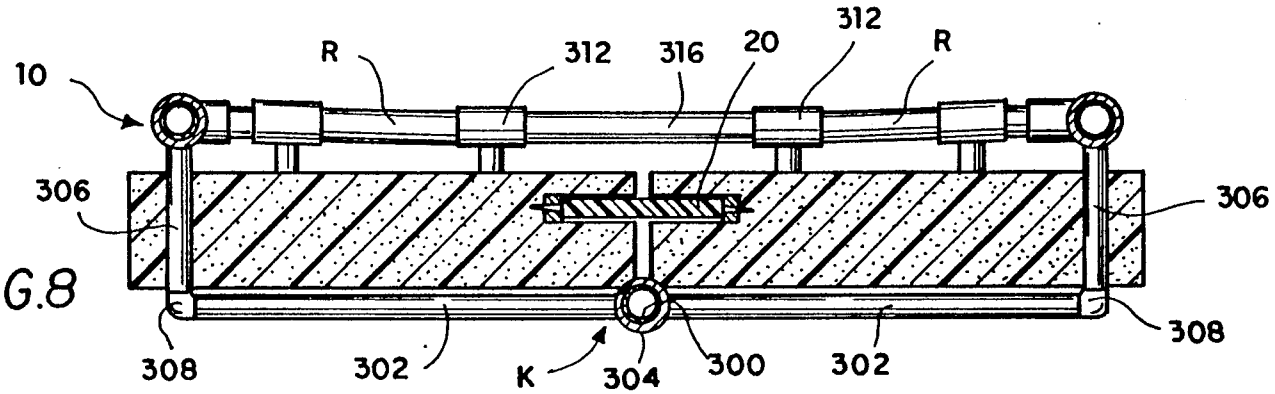
FIG. 8 is a transverse sectional view drawn along lines 8—8 of FIG. 6.

A second embodiment of the invention is illustrated in FIGS. 6-9, inclusive. In most respects, this embodiment is the same as the first embodiment, except for the lack of the flexible nylon hinge 200 and the shape of bow B and stern S. Here, a keel or spine K is provided by lengths of three quarter inch PVC pipe 300, with laterally projecting ribs 302, each connected to keel pipe 300 by a swivel tee 304. In turn, the ribs 302 are connected to selected vertical stanchions 306 of railing R by 90° elbows 308, as best seen in FIGS. 8 and 9, to form a grid configured, structurally rigid framework for raft 10. The elbows 40 and 42 at the bow and stern ends of the raft are replaced by a pair of 45° PVC pipe elbows 312, 314, interconnected by a short length PVC pipe section 316, 318, respectively. The pipe sections 316, 318 are friction fit in place only, so as to be readily removed from at least one of the elbows making up the pairs of elbows 312, 314, respectively, when the raft is to be folded for transport and/or storage. The folding together of the two sections in this embodiment is illustrated in FIG. 9.

Figure 4:
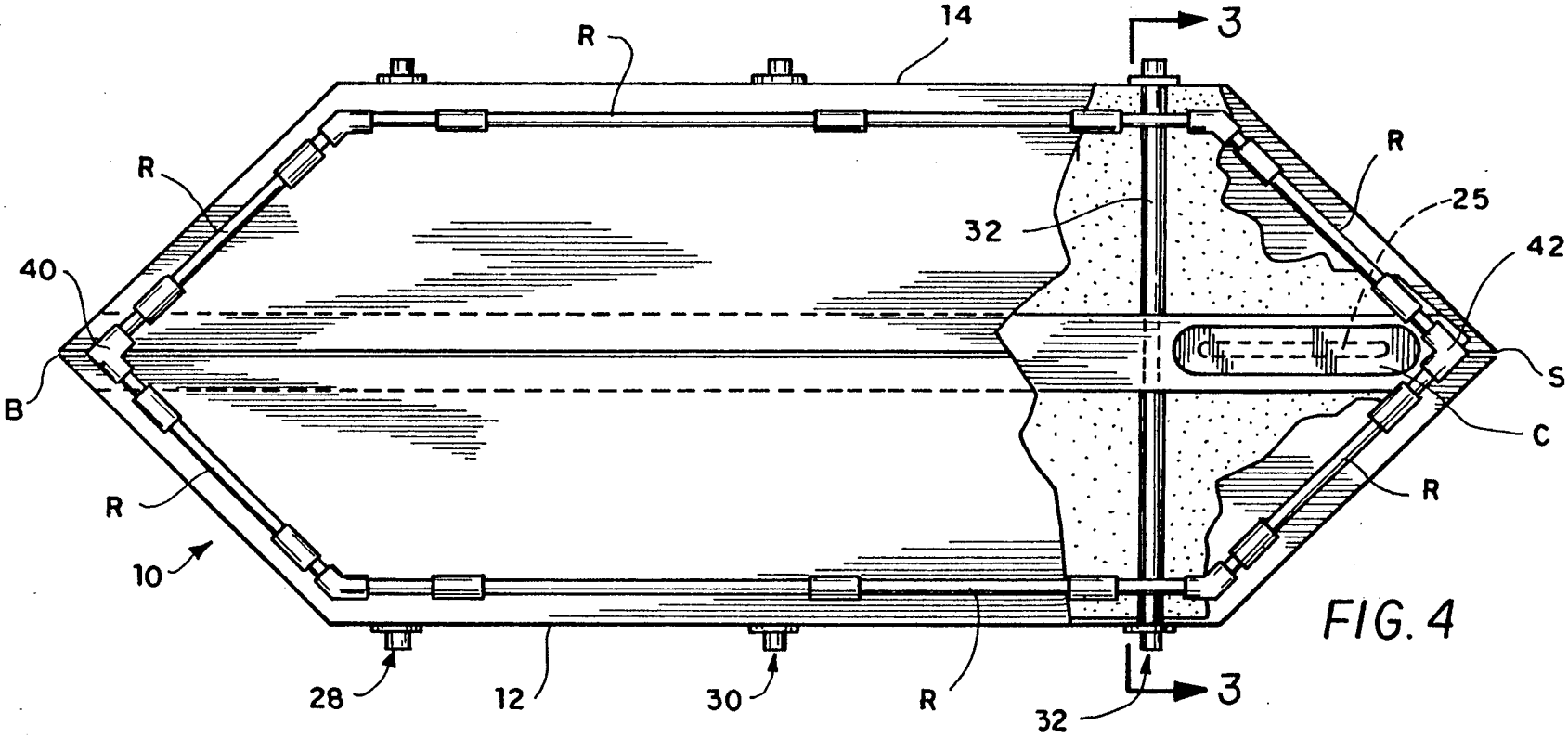
FIG. 4 is a top, plan view of the raft as shown in FIG. 1, with parts broken away to reveal interior detail.
Figure 5:
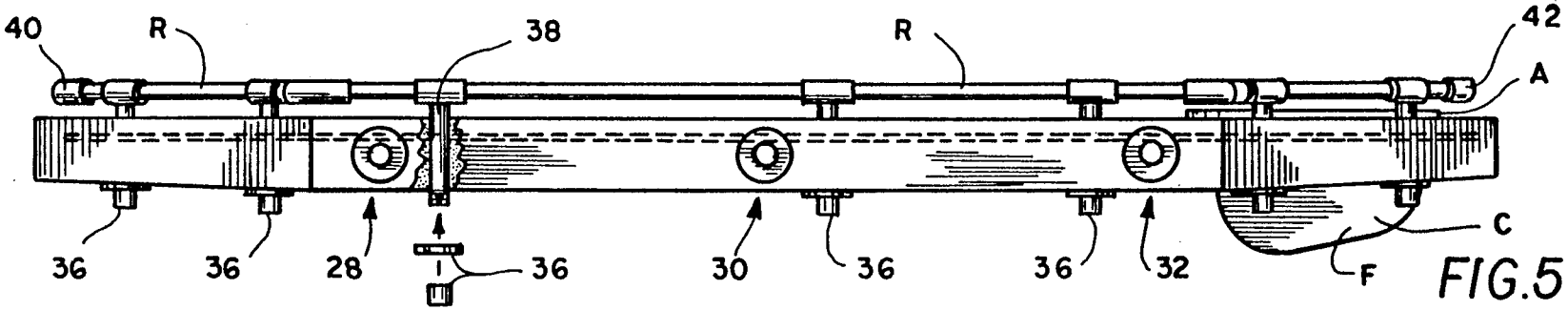
FIG. 5 is a side, elevational view of the raft as shown in FIG. 4.

Optionally incorporated in either of these embodiments is a centerboard C with a handle A and a fin F shown in FIGS. 4, 5, 6, and 7. With this option, pertaining to the first embodiment, the nylon strap 200 is not used and the raft assembly is stackable for transport once the transverse pipes or stiffeners 28, 30, and 32 are removed. Referring to FIGS. 4 and 5, the centerboard C fits through a slot 25 in the spline 20 and is held in place between sections 12 and 14. In FIGS. 6 and 7, the centerboard C fits in a slot 55 that extends through the deck D.

Various mixtures of the above described embodiments are possible. For example, the elongate structural rails 22, 24 in the first embodiment could be provided in the others. The spline 20 could be deleted from the first embodiment and added to the second. The shapes of the bow and stern in each of the first and second embodiments are not exclusive to those embodiments. In all the above discussed embodiments, the common theme is a foldable raft made mainly of very inexpensive materials, e.g., foam plastic and PVC (or CPVC or aluminum, if desired) pipe sections and tees. Three quarter inch PVC pipe was selected as an example; slightly larger or smaller pipe could be used.

Figure 11:
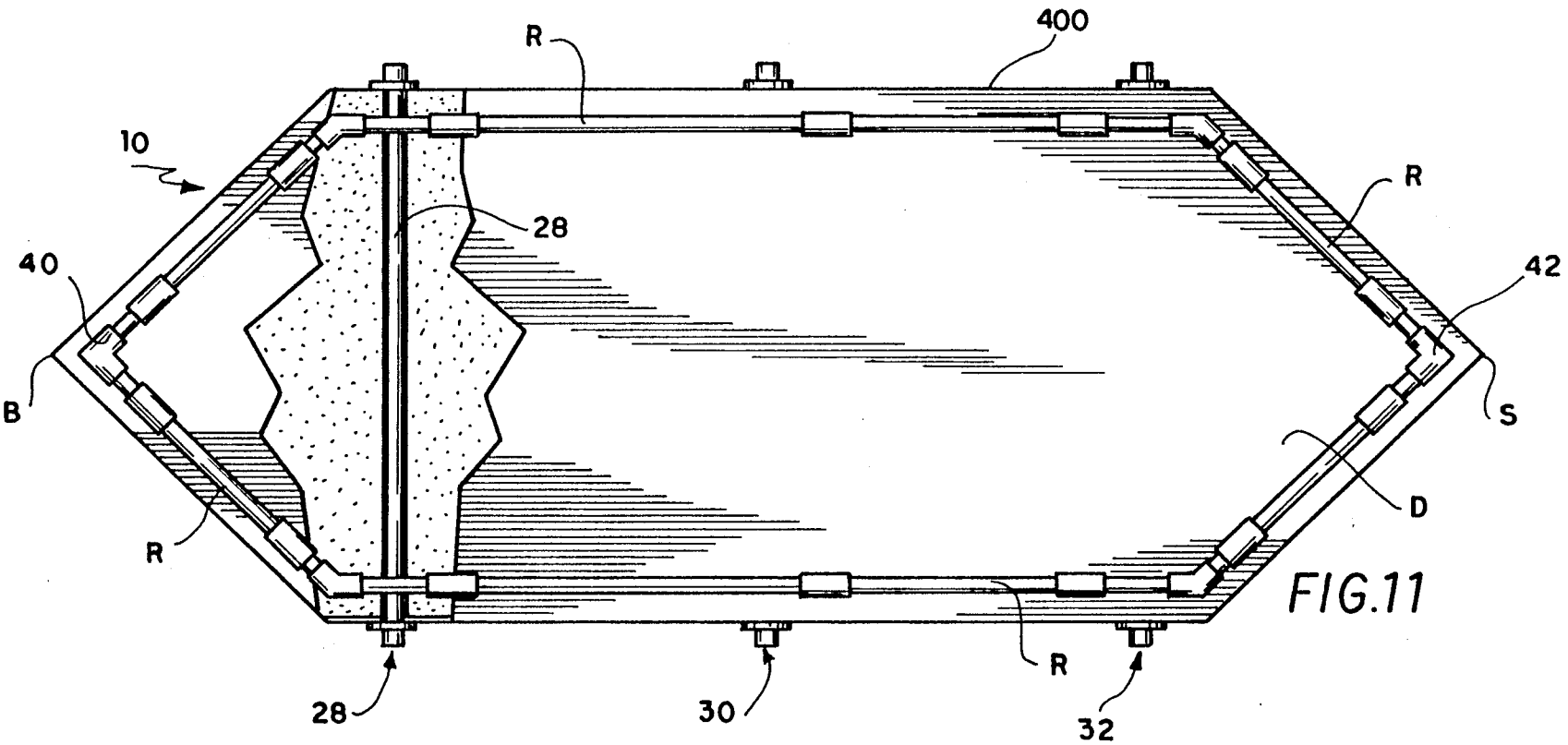
FIG. 11 is a top plan view of a single piece embodiment of the invention.
Figure 12:
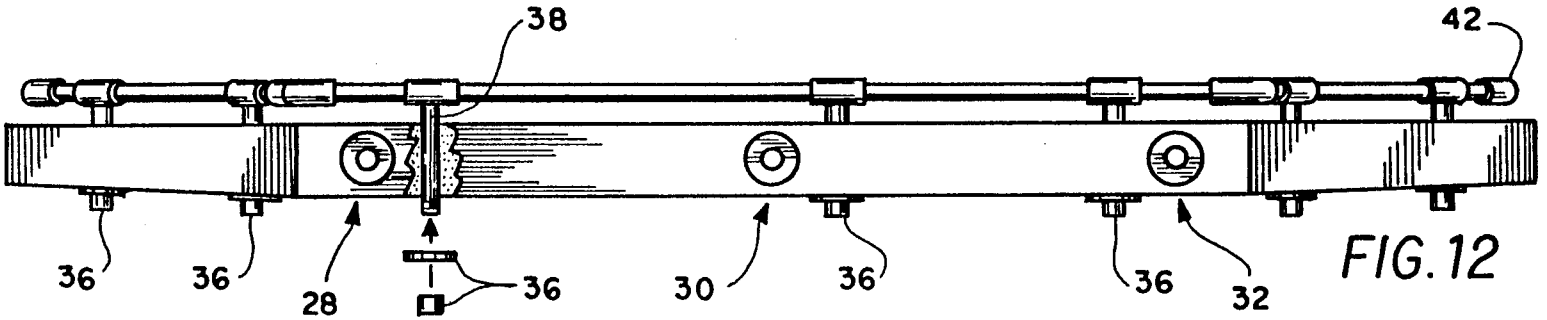
FIG. 12 is a side elevational view of the invention shown in FIG. 11.

Referring to FIGS. 11 and 12, a single piece embodiment of the invention is shown. It is similar to the previously discussed embodiments excepting that it is made of one piece of foam material 400 and is, of course, not foldable. The transverse stiffeners 28, 30, and 32 are the same as in the first embodiment, as are the cap and washer assemblies 36, the railing R, its bow and stern pipe elbows 40 and 42, and the vertical stanchions 38. Optionally, a centerboard C with a handle A and a fin F could be added to this embodiment as in the second embodiment, with a slot extending through the deck D.

It is to be understood that the present invention is not limited to the embodiments described above, but encompasses any and all embodiments within the scope of the following claims.

I claim:

1. A foldable, transportable raft assembly having a bow, a stern, a keel, a deck and a hull, and comprising:

a pair of substantially identical, symmetrical raft sections which, in assembly, are joined together along a longitudinal, vertical center plane running from said bow to said stern to form a generally solid, floating raft, each of said pair of raft sections comprising a solid block of substantially closed cell, synthetic foam material, and having a bow end and a stern end, each said raft section being configured to form one half of said raft and including a vertical, planar face extending from said bow end of said raft section to said stern end of said raft section;

said keel comprising a generally elongate, flat, strap of nylon and means for joining said elongate, flat strap to a hull portion of each said raft section, such that said raft sections abut against one another along said vertical center plane to form said raft assembly, and are foldable so that said hull portion of each said raft section are arranged generally parallel one another for transport; and rib means interconnecting said raft sections when assembled to form said raft, and extending transversely of said raft sections, through said vertical center plane, thus to provide a structurally integral raft assembly ready for use.

2. The invention as claimed in claim 1, wherein said raft assembly further comprises a generally elongate, flexible, flat spline located transversely through said vertical center plane, and means for affixing said spline to one of said raft sections, through said planar face of said one raft section.

3. The invention as claimed in claim 2, wherein said raft assembly further comprises a pair of extended length aluminum stiffening rails, one for each raft section and mounted internally of each raft section, adjacent said flat spline and arranged generally parallel thereto, for imparting additional structural strength to said raft assembly.

4. The invention as claimed in claim 2, wherein said spline has means defining a slot along said center planes and, a removable centerboard comprising a handle and a fin, said fin attached to said handle and being slightly smaller than said slot; whereby said centerboard can be placed in and removed from said slot.

5. The invention as claimed in claim 1, wherein said rib means comprise a plurality of pipe sections, means defining a plurality of transverse bores entirely through said raft sections, for receiving said pipe sections, said pipe sections having opposite ends extended entirely through said raft sections, and removable cap means attached to said pipe section opposite ends for securing said pipe sections in place, thus to impart structural rigidity to said raft assembly, said pipe sections being removed to permit said raft sections to be folded downwardly about an axis defined by said keel.

6. The invention as claimed in claim 2, wherein said rib means comprise a plurality of pipe sections, means defining a plurality of transverse bores entirely through said raft sections, for receiving said pipe sections, said pipe sections having opposite ends extended entirely through said raft sections, and removable cap means attached to said pipe section opposite ends for securing said pipe sections in place, thus to impart structural rigidity to said raft assembly, said pipe sections being removed to permit said raft sections to be folded downwardly about an axis defined by said keel.

7. The invention as claimed in claim 1, said raft assembly further comprising rail means affixed to the deck of each said raft section, a plurality of vertical stanchions, each having an upper end attached to said rail means and a lower end extended through said raft assembly hull and secured thereto and therebeneath, and cap means attached to each of said stanchion lower ends for securing said stanchion lower ends to said raft assembly hull.

8. The invention as claimed in claim 2, said raft assembly further comprising rail means affixed to the deck of each said raft section, a plurality of vertical stanchions, each having an upper end attached to said rail means and a lower end extended through said raft assembly hull and secured thereto and therebeneath, and cap means attached to each of said stanchion lower ends for securing said stanchion lower ends to said raft assembly hull.

9. The invention as claimed in claim 5, said raft assembly further comprising rail means affixed to the deck of each said raft section, a plurality of vertical stanchions, each having an upper end attached to said rail means and a lower end extended through said raft assembly hull and secured thereto and therebeneath, and cap means attached to each of said stanchion lower ends for securing said stanchion lower ends to said raft assembly hull.

10. A foldable, transportable raft assembly having a bow, a stern, a keel, a deck and a hull, and comprising:

a pair of substantially identical, symmetrical raft sections which, in assembly, are joined together along a longitudinal, vertical center plane running from said bow to said stern to form a generally solid, floating raft, each of said pair of raft sections comprising a solid block of substantially closed cell, synthetic foam material, and having a bow end and a stern end, each said raft section being configured to form one half of said raft and including a vertical, planar face extended from said bow end of each said raft section to said stern end of each said raft section;

said raft sectins including an elongate spine forming said keel, located along said center plane, and means for joining said spine to said each of said raft sections such that said raft sections abut against one another along said center plane to form said raft assembly, and are foldable so that hull portions of each said raft section are arranged generally parallel one another for transport;

rib means interconnecting said raft sections when assembled to form said raft, and extending transversely of said raft sections, through said center plane, thus to provide a structurally integral raft assembly ready for use; and a spline comprising a generally elongate, flexible, flat piece of material located transversely through said vertical center plane, and means for affixing said spline to each of said raft sections, through said planar face of each said raft section;

said rib means comprising a plurality of pipe sections, means defining a plurality of transverse bores entirely through said raft sections, for receiving said pipe sections, said pipe sections having opposite ends extending entirely through said raft sections, and removable cap means attached to said pipe section opposite ends for securing said pipe sections in place, thus to impart structural rigidity to said raft assembly, said pipe sections being removed to permit said raft sections to be folded downwardly about an axis defined by said keel.

11. A foldable, transportable raft assembly having a bow, a stern, a keel, a deck and a hull, and comprising:

a pair of substantially identical, symmetrical raft sections which, in assembly, are joined together along a longitudinal, vertical center plane running from said bow to said stern to form a generally solid, floating raft, each of said pair of raft sections comprising a solid block of substantially closed cell, synthetic foam material, and having a bow end and a stern end, each said raft section being configured to form one half of said raft and including a vertical, planar face extended from said bow end of each said raft section to said stern end of each said raft section;

said keel comprising an elongate spine located in said center plane, and means for joining said spine to each of said raft sections such that said raft sections abut against one another along said center plane to form said raft assembly, and are foldable downwardly so that hull portions of each said raft section face one another, said raft sections thus being disposed generally parallel one another for transport; and rib means interconnecting said raft sections when assembled to form said raft, and extending transversely of said raft sections, through said center plane thus to provide a structurally integral raft assembly ready for use;

said keel spine comprising a length of pipe located in said center plane directly beneath said raft assembly hull, said means for joining comprising transverse pipe elements extended outwardly from and to each side of said length of pipe and each of said transverse pipe elements being secured to both said length of pipe and a respective raft section;

said raft assembly further comprising rail means affixed to the deck of each said raft section, a plurality of vertical stanchions, each having an upper end attached to said rail means and a lower end extended through said raft assembly hull and secured thereto and therebeneath, cap means attached to selected ones of said stanchion lower ends, for securing said selected ones of said stanchion lower ends to said raft assembly hull, and means for selectively attaching other ones of said stanchion lower ends to said rib means.

12. A transportable raft assembly having a bow, a stern, a deck and a hull, and comprising:

a solid, unitary block of substantially closed cell, synthetic foam material, having a bow end, a stern end, and a longitudinal axis;

rail means affixed to the deck of said block, a plurality of vertical stanchions, each having an upper end attached to said rail means and a lower end extended through said raft assembly hull and secured thereto and therebeneath, and cap means attached to each of said stanchion lower ends for securing said stanchion lower ends to the raft assembly hull; and rib means perpendicular to said longitudinal axis and extending transversely through said block, thus providing a structurally integral raft assembly, ready for use.

* * * * *